US008768216B2

(12) United States Patent
Gumina et al.

(10) Patent No.: US 8,768,216 B2
(45) Date of Patent: Jul. 1, 2014

(54) CONTROL OF PHOTORECEPTOR BELT DETENSIONING CYCLES USING EXTENDED SLOWER BELT ROTATION

(75) Inventors: Michael L. Gumina, Walworth, NY (US); Mark A. Atwood, Rush, NY (US); John T Buzzelli, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 152 days.

(21) Appl. No.: 13/589,275

(22) Filed: Aug. 20, 2012

(65) Prior Publication Data

US 2014/0050495 A1 Feb. 20, 2014

(51) Int. Cl.
*G03G 15/00* (2006.01)
*G03G 15/16* (2006.01)

(52) U.S. Cl.
CPC ..... *G03G 15/754* (2013.01); *G03G 15/5008* (2013.01); *G03G 15/1615* (2013.01); *G03G 2215/00139* (2013.01)
USPC ..... 399/165; 399/43; 399/85

(58) Field of Classification Search
CPC ..... G03G 15/1615; G03G 15/5008; G03G 15/754; G03G 2215/00139
USPC ..... 399/43, 85, 162, 165
See application file for complete search history.

(56) References Cited

U.S. PATENT DOCUMENTS

| | | | | |
|---|---|---|---|---|
| 5,243,384 | A | 9/1993 | Everdyke et al. | |
| 5,946,523 | A * | 8/1999 | Fujioka et al. | 399/49 |
| 6,032,004 | A | 2/2000 | Mirabella, Jr. et al. | |
| 6,101,353 | A | 8/2000 | Yu et al. | |
| 6,269,231 | B1 | 7/2001 | Castelli et al. | |
| 6,560,428 | B2 | 5/2003 | Sanchez-Banos et al. | |
| 7,024,136 | B2 | 4/2006 | Fiore et al. | |
| 7,526,229 | B1 | 4/2009 | Liu et al. | |
| 7,603,073 | B2 * | 10/2009 | Kojima | 399/396 |

* cited by examiner

*Primary Examiner* — Walter L Lindsay, Jr.
*Assistant Examiner* — Benjamin Schmitt
(74) *Attorney, Agent, or Firm* — Gibb & Riley, LLC

(57) ABSTRACT

A processor places a printer apparatus in a reduced activity mode after printing requests have not been received for an "inactivity" time period. A belt support device rotates a photoreceptor belt at a reduced speed when the printer apparatus enters the reduced activity mode and for a "delay" time period after the printer apparatus enters the reduced activity mode. The belt support device returns the rotational speed of the photoreceptor belt to the original speed if a new printing request is received during the delay time period. However, the belt support device stops rotation of the photoreceptor belt and reduces the belt tension if the delay time period expires without receiving a new printing request.

20 Claims, 4 Drawing Sheets

CONTROL OF PHOTORECEPTOR BELT DETENSIONING CYCLES USING EXTENDED SLOWER BELT ROTATION

BACKGROUND

Embodiments herein generally relate to printers and printing systems, and more particularly to extending the life of photoreceptor belts by controlling photoreceptor belt detensioning cycles using extended slower belt rotation.

Modern electrostatic printing devices use a photoreceptor belt as a platform to accept a patterned charge, collect toner in the pattern represented by the charge, and transfer the toner to a media material. The media can be, for example, a continuous roll or web of material, or can be cut sheets. The media can be any suitable material including paper, plastic, transparencies, etc.

The photoreceptor belt needs to be durable, yet cannot be excessively expensive. Therefore, a number of systems and processes are used to extend the life of photoreceptor belts.

SUMMARY

An exemplary printer apparatus herein comprises a processor, and a media path operatively connected to the processor. The media path transports print media within the printer apparatus. A dispensing apparatus is operatively connected to the processor, and the dispensing apparatus maintains a marking material, such as toner. A charging device is operatively connected to the processor, as is a belt, such as a photoreceptor belt. The photoreceptor belt is positioned adjacent the dispensing apparatus and the charging device. The charging device transfers a charge pattern to the photoreceptor belt, and the dispensing apparatus places the toner on the photoreceptor belt, based on the charge pattern. The photoreceptor belt then transfers the toner to the print media.

Further, a belt support device (comprising a frame, drive and idle rollers, actuators, etc.) is operatively connected to the processor, and the photoreceptor belt is mounted on the belt support device. The belt support device controls the rotational speed and the belt tension of the photoreceptor belt. The belt support device rotates the photoreceptor belt at a first speed and maintains the belt tension at a first tension when the photoreceptor belt is transferring the toner to the print media.

The processor places the printer apparatus in a reduced activity mode after printing requests have not been received for a previously set "inactivity" time period. The belt support device rotates the photoreceptor belt at a second speed, that is less than the first speed, when the printer apparatus enters the reduced activity mode and for a previously set "delay" time period after the printer apparatus enters the reduced activity mode. For example, the second speed can be less than 10% of the first speed. The belt support device returns the rotational speed of the photoreceptor belt to the first speed if a new printing request is received during the delay time period. However, the belt support device stops rotation of the photoreceptor belt and reduces the belt tension (to a second tension, less than the first tension) if the delay time period expires without receiving a new printing request. For example, the second tension can be less than 50% of the first tension. The belt support device returns the rotational speed of the photoreceptor belt to the first speed, and returns the belt tension to the first tension, when a new printing request is received after the delay time period has expired.

In additional embodiments, the processor can track the pattern of delay between successive print requests. The processor can then adjust the delay time period to reduce the frequency of changing the belt tension, based on the pattern of delay between successive print requests.

An exemplary method herein transports the print media within the printer apparatus using the media path within the printer apparatus, and places marking material on the belt within the printer apparatus using a dispensing apparatus within the printer apparatus. Again, the dispensing apparatus maintains the marking material. The method also transfers the marking material from the belt to the print media.

The method supports the belt using a belt support device within the printer apparatus, and controls the rotational speed of the belt and belt tension of the belt using the belt support device. The method rotates the belt at a first speed and maintains the belt tension at a first tension when the belt is transferring the marking material to the print media, using the belt support device.

This exemplary method places the printer apparatus in a reduced activity mode if new printing requests are not received for an inactivity time period, using a processor within the printer apparatus. Further, this method rotates the belt at a second speed, less than the first speed, when the printer apparatus enters the reduced activity mode and for a delay time period after the printer apparatus enters the reduced activity mode, using the belt support device. The method returns the rotational speed of the belt to the first speed if a new printing request is received during the delay time period, using the belt support device. The method can stop the rotation of the belt and reduce the belt tension to a second tension, less than the first tension, if the delay time period expires without receiving a new printing request, using the belt support device. Additionally, the method returns the rotational speed of the belt to the first speed and returns the belt tension to the first tension when a new printing request is received after the delay time period has expired, using the belt support device.

Further, these methods can track the pattern of delay between successive print requests, and adjust the delay time period to reduce a frequency of when the belt tension is changed based on the pattern of delay between successive print requests, using the processor.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
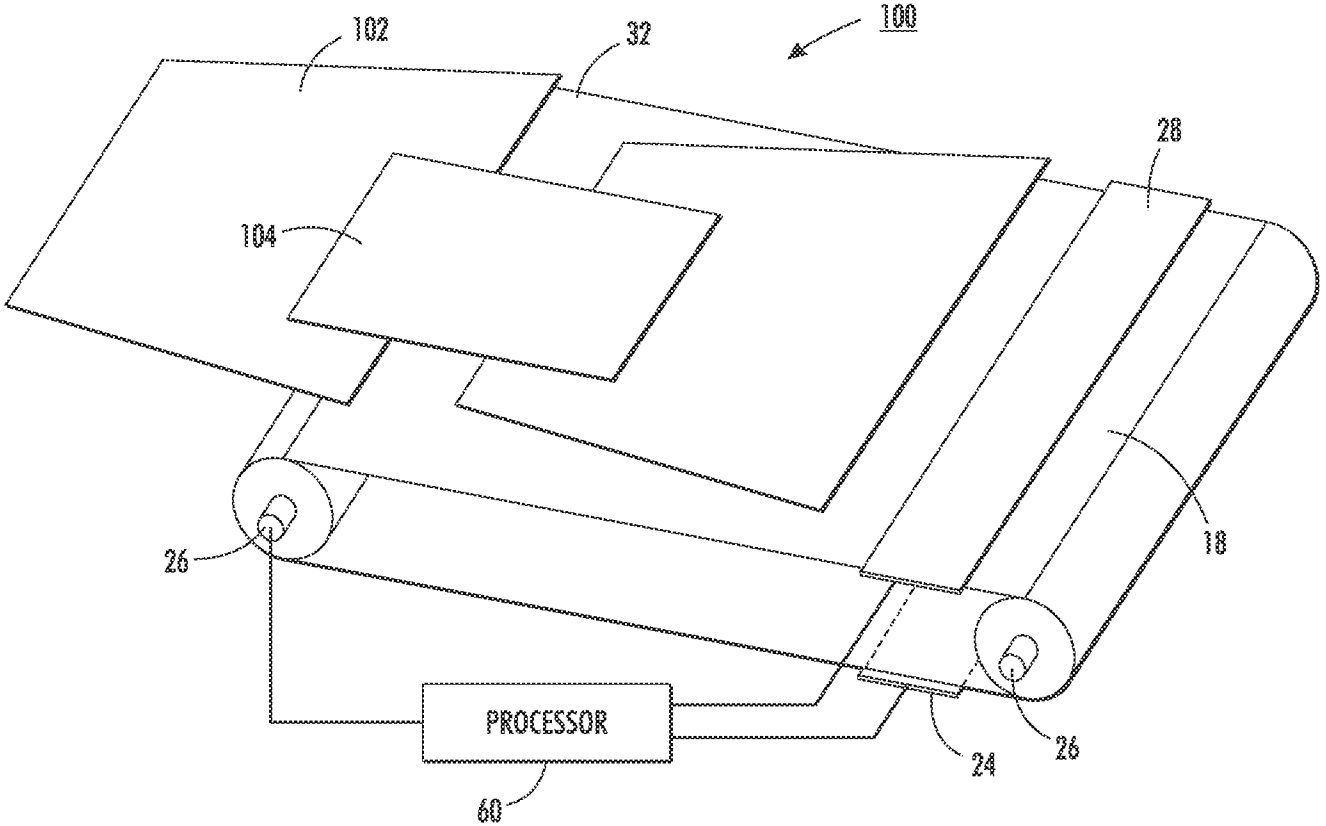
FIG. 1 is a perspective-view schematic diagram of a device according to embodiments herein.
Figure 2:
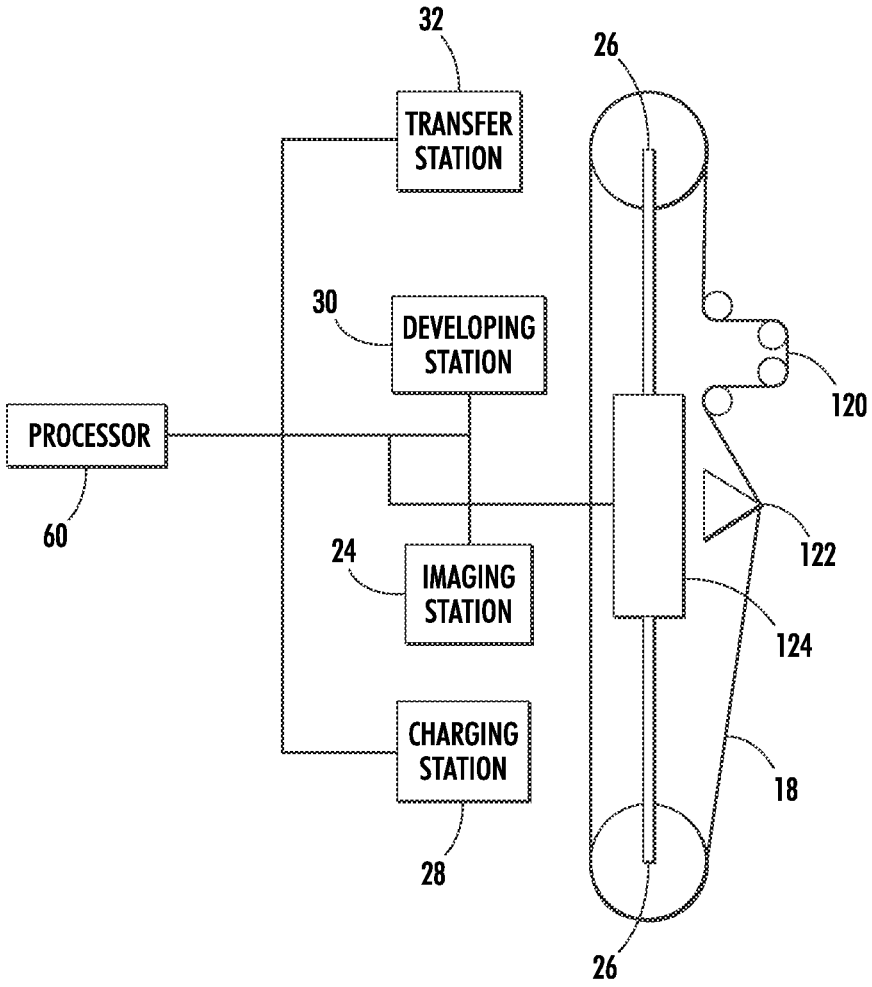
FIG. 2 is a side-view schematic diagram of a device according to embodiments herein.

Image quality (IQ) defects are sometimes attributed the photoreceptor (PR) belt, such as the belt 18 shown in FIGS. 1 and 2, being statically tensioned (stopped under tension) over a tight bending radius of structures such as a sharply pointed object 122 or one or more rolls 120 (FIG. 2). Damage to the photoreceptor belt can occur each time the machine cycles down and the photoreceptor belt is stopped and allowed to remain under tension. The damage is increased especially where the machine may be idle for extended periods of time. The area of the photoreceptor belt that is touching sharply angled items 120, 122 can induce an image quality defect in the print the next time the machine cycles up for a print job.

One solution to the foregoing is to detension (reduce tension on) the belt after every print job. This may require the detensioning hardware to cycle repeatedly, which can excessively wear the belt tensioning equipment. Further, the belt itself can only be placed through a finite number of tensioning cycles (a cycle of tensioning and detensioning) before it become defective and needs to be replaced. Therefore, systems and methods herein place the photoreceptor belt into crawl mode for an extended delay time period instead of immediately detensioning when a printing machine becomes idle. Crawl mode causes the belt to slowly rotate for some period of time (e.g., 10-30 minutes) before stopping and detensioning the photoreceptor belt. Crawl mode prevents exercising the detensioning hardware more often than its original design and eliminates the need for a new design An exemplary printer apparatus 100 herein comprises a processor 60, and a media path 102 operatively connected to the processor 60. The media path 102 transports print media 104 within the printer apparatus 100. A dispensing apparatus 24, such as an imaging station, is operatively connected to the processor 60, and the dispensing apparatus 24 maintains a marking material, such as toner. A charging device 28 is operatively connected to the processor 60, as is a belt, such as a photoreceptor belt 18. The photoreceptor belt 18 is positioned adjacent the dispensing apparatus 24 and the charging device 28. The charging device 28 transfers a charge pattern to the photoreceptor belt 18, and the dispensing apparatus 24 transfers toner to the photoreceptor belt 18, based on the charge pattern. The photoreceptor belt 18 then transfers the toner to the print media 104 at the transfer station 32.

Further, a belt support device 124 (comprising a frame, drive and idle rollers 26, actuators, etc.) is operatively connected to the processor 60, and the photoreceptor belt 18 is mounted on the belt support device 124. While a simplified frame and actuators connected to the rollers 26 is illustrated in FIG. 2, those ordinarily skilled in the art would understand that many different types of tension adjustment systems can be utilized with the systems and methods herein. Therefore, many more or less frame members, more or less actuators, etc., can be included in the belt support device 124. Additionally, the belt support device 124 is considered, in this example, to also control the rotational speed of the rollers 26. While the arbitrarily named "belt support device" 124 controls these various functions in this example, those ordinarily skilled in the art would understand that these functions could be performed by many separate devices, or the control could be grouped under the functions of a different device, depending upon specific implementation and design of the specific printing device, and that the systems and methods defined by the claims are not limited to the examples shown in the drawings.

Therefore, the belt support device 124 controls the rotational speed and the belt tension of the photoreceptor belt 18. The belt support device 124 rotates the photoreceptor belt 18 at a first (high) speed and maintains the belt tension at a first (high) tension when the photoreceptor belt 18 is transferring the toner to the print media 104. Thus, when the printing device is operating in its normal high-power mode and is placing markings on the print media, the photoreceptor belt 18 rotates at its highest operational speed and highest operational tension.

The processor 60 places the printer apparatus 100 in a reduced activity mode after printing requests have not been received for a previously set "inactivity" time period. This is commonly referred to as "sleep" mode, which is a feature provided in many devices to reduce power consumption and wear on critical components. While in the reduced activity or sleep mode, many components are shut down and only a few components that allow the device to quickly resume operation are kept active. For example, one sleep mode operation can be to stop rotation of the photoreceptor belt and reduce tension. However, reducing tension every time the printing device enters sleep mode can unnecessarily increase the number of tensioning cycles that the photoreceptor belt experiences, leading to a shorter useful life.

With systems and methods herein, the photoreceptor belt 18 is not detensioned every time the printing device enters sleep mode in order to reduce the number of tensioning cycles. Further, in order to avoid problems that can occur when the photoreceptor belt 18 is stopped under tension discussed above, systems and methods herein continued to rotate the photoreceptor belt 18 even in sleep mode. However, in order to reduce wear on the rollers, belt, and motors (and to reduce power consumption) the speed of the belt rotation is substantially reduced. This allows the systems and methods herein to enjoy the benefits of the sleep mode (with reduced wear and reduced power consumption) yet avoids the problem of excessive tensioning cycles, and the problems associated with stopping a photoreceptor belt under tension.

Thus, the belt support device 124 rotates the photoreceptor belt 18 at a second (lower) speed, that is less than the first speed, when the printer apparatus 100 enters the reduced activity mode and for a previously set "delay" time period after the printer apparatus 100 enters the reduced activity mode. For example, the second speed can be less than 30%, less than 10%, less than 5% of the first speed.

The belt support device 124 returns the rotational speed of the photoreceptor belt 18 to the first speed if a new printing request is received during the delay time period. However, the belt support device 120 stops rotation of the photoreceptor belt 18 and reduces the belt tension (to a second tension, less than the first tension) if the delay time period expires without receiving a new printing request. For example, the second tension can be less than 70%, less than 50%, less than 25%, etc., of the first tension. The belt support device 120 returns the rotational speed of the photoreceptor belt 18 to the first speed, and returns the belt tension to the first tension, when a new printing request is received after the delay time period has expired.

In additional embodiments, the processor 60 can track the pattern of delay between successive print requests. The processor 60 can then adjust the delay time period to reduce the frequency of changing the belt tension, based on the pattern of delay between successive print requests.

Thus, the delay time period may initially extend the detentioning of photoreceptor belt 18 beyond the entry into the reduced activity mode by 20 minutes. However, if the tracking of the pattern of delay between successive print request shows that the mean or average time between successive printing requests for a specific printing machine is 30 minutes, the delay time can be extended from 20 minutes to 30 minutes for that specific printing machine. Similarly, the systems and methods herein can use more elaborate modeling of printing activity periods that may determine, for example, that once a specific printing device goes unused for 25 minutes, it usually goes unused for hours (which would allow the system to reset the delay time period to 25 minutes). Additionally, the delay time period can be customized for weekdays versus weekends, normal business operating hours versus nighttime, etc. The adjustment of the delay time period is automated and dynamic, allowing the number of tensioning cycles to be minimized for each machine as the use of that machine changes over time.

Figure 3:
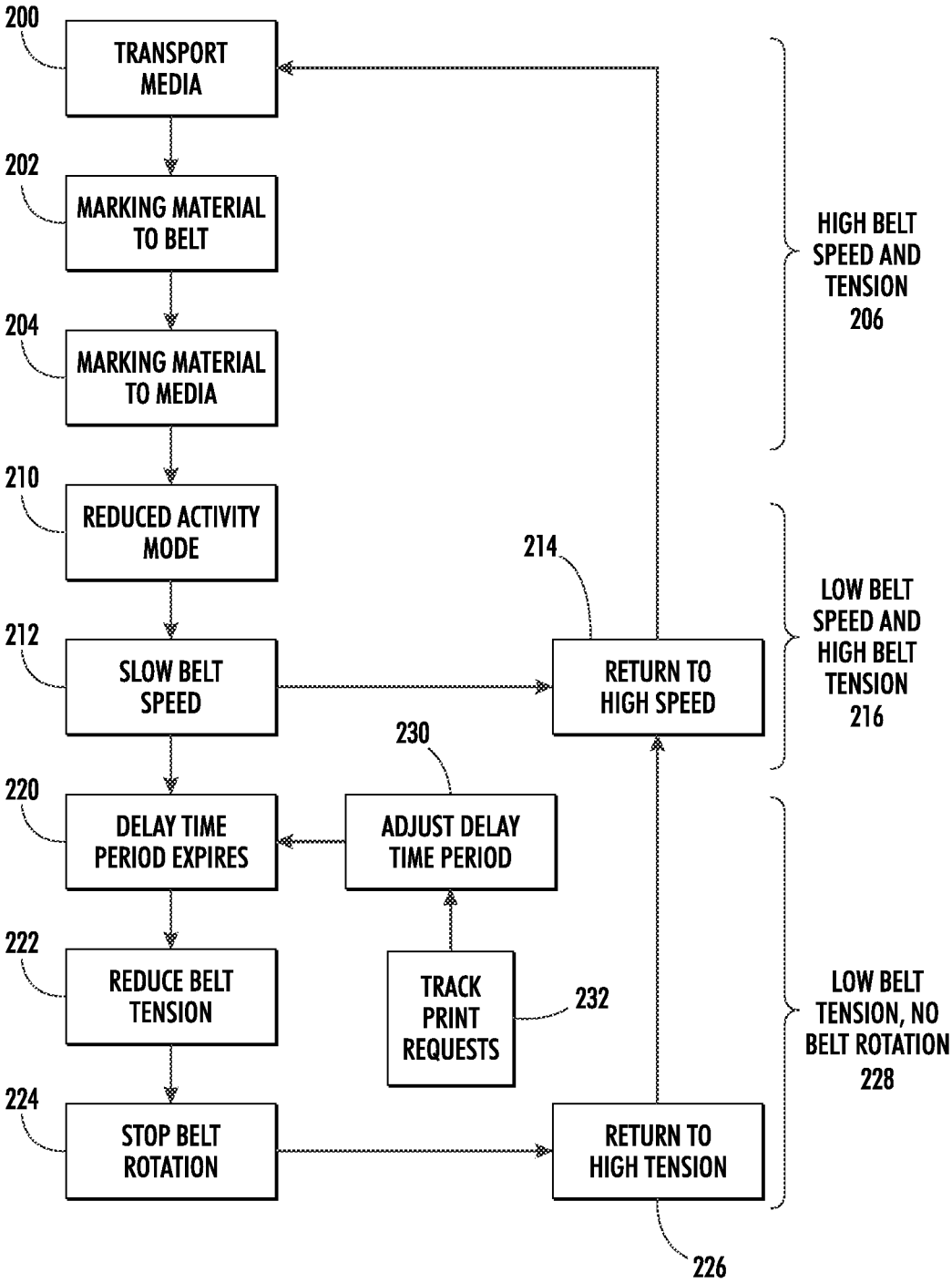
FIG. 3 is a flow diagram illustrating various method embodiments herein.

FIG. 3 is flowchart illustrating an exemplary method herein. In item 200, this method transports the print media within the printer apparatus using the media path within the printer apparatus. The method also places marking material on the belt within the printer apparatus using a dispensing apparatus within the printer apparatus in item 202. Again, the dispensing apparatus maintains the marking material. The method also transfers the marking material from the belt to the print media in item 204.

The method supports the belt using a belt support device within the printer apparatus, and controls the rotational speed of the belt and belt tension of the belt using the belt support device. The method rotates the belt at a first (high) speed and maintains the belt tension at a first (high) tension when the media is being transported, the marking media is being transported to the belt, and the belt is transferring the marking material to the print media in item 206, using the belt support device.

This exemplary method places the printer apparatus in a reduced activity mode 210 if new printing requests are not received for an "inactivity time period", using a processor within the printer apparatus. Further, this method slows the belt speed 212 and rotates the belt to a second speed, less than the first speed, when the printer apparatus enters the reduced activity mode and for a "delay time period" after the printer apparatus enters the reduced activity mode, using the belt support device. The method returns the rotational speed of the belt to the first (higher) speed if a new printing request is received during the delay time period in item 214, using the belt support device. Thus, the method rotates the belt at the lower speed, but maintains the belt tension at a first (higher) tension 216 from the time when the printer enters the reduced activity mode until the delay time period expires in item 220.

When the delay time period expires (when the printer has been in the reduced activity mode for the delay time period) the method can reduce the belt tension to a second tension 222 and stop the rotation of the belt 224 and, less than the first tension, if the delay time period expires without receiving a new printing request, using the belt support device. Additionally, the method returns the belt tension to the first tension 226 and returns the rotational speed of the belt to the first speed 214 when a new printing request is received after the delay time period has expired, using the belt support device. Thus, after the delay time period expires, the belt tension is reduced and the belt is stopped, as shown by item 228.

Further, these methods can track the pattern of delay between successive print requests in item 232, and adjust the delay time period in item 230 to reduce the frequency of when the belt tension is changed based on the pattern of delay between successive print requests, using the processor.

Figure 4:
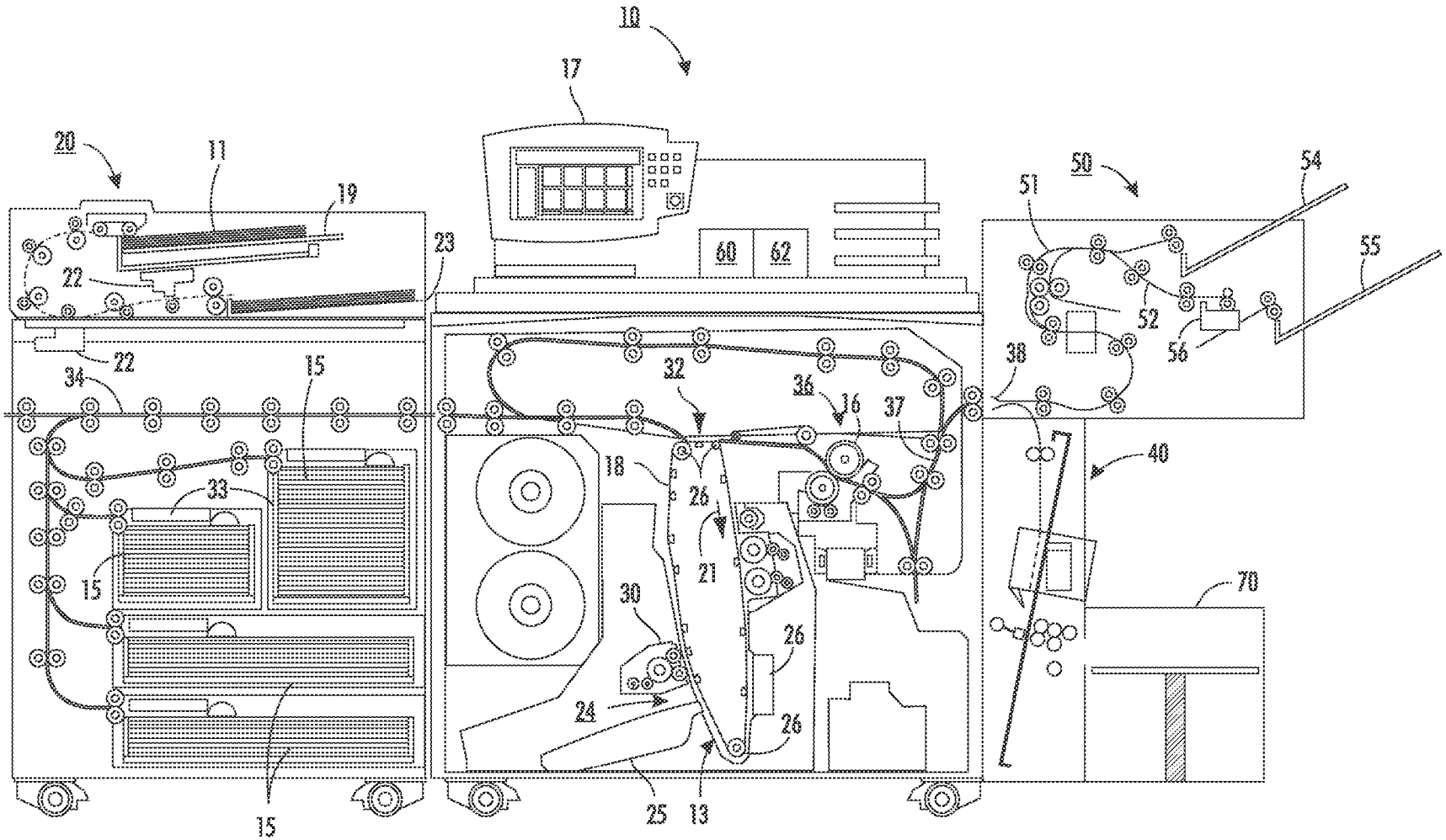
FIG. 4 is a side-view schematic diagram of a device according to embodiments herein.

Referring to the FIG. 4 a more detailed printing machine 10 that is similar to those shown in FIGS. 1 and 2 is illustrated that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-transitory storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices that contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 4 is only one example and the embodiments herein are equally applicable to other types of printing devices that may include fewer components or more components. For example, while a limited number of printing engines and paper paths are illustrated in FIG. 4, those ordinarily skilled in the art would understand that many more paper paths and additional printing engines could be included within any printing device used with embodiments herein.

In such a computerized (printing) device 10, the processor 60 in the control panel 17 the processor 60 places the printer apparatus in a reduced activity mode after printing requests have not been received for a previously set "inactivity" time period. The processor 60 controls the belt support device to rotate the photoreceptor belt at a second speed, that is less than the first speed, when the printer apparatus enters the reduced activity mode and for a previously set "delay" time period after the printer apparatus enters the reduced activity mode. The processor 60 controls the belt support device to return the rotational speed of the photoreceptor belt to the first speed if a new printing request is received during the delay time period.

However, the processor 60 controls the belt support device to stop rotation of the photoreceptor belt and reduces the belt tension (to a second tension, less than the first tension) if the delay time period expires without receiving a new printing request. The processor 60 controls the belt support device to return the rotational speed of the photoreceptor belt to the first speed, and return the belt tension to the first tension, when a new printing request is received after the delay time period has expired. The processor 60 can also track the pattern of delay between successive print requests and then adjust the delay time period to reduce the frequency of changing the belt tension, based on the pattern of delay between successive print requests.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the embodiments herein cannot be implied or imported from any above example as limitations to any particular order, number, position, size, shape, angle, color, or material.

What is claimed is:

1. A printer apparatus comprising:

a processor;

a media path operatively connected to said processor, said media path transporting print media within said printer apparatus;

a dispensing apparatus operatively connected to said processor, said dispensing apparatus maintaining marking material;

a belt operatively connected to said processor, said belt being positioned adjacent said dispensing apparatus, said dispensing apparatus placing said marking material on said belt, said belt transferring said marking material to said print media; and a belt support device operatively connected to said processor, said belt being mounted on said belt support device, said belt support device controlling a rotational speed of said belt and a belt tension of said belt, said belt support device rotating said belt at a first speed and maintaining said belt tension at a first tension when said belt is transferring said marking material to said print media, said processor placing said printer apparatus in a reduced activity mode based on a lack of printing requests being received for an inactivity time period, said belt support device rotating said belt at a second speed, less than said first speed, when said printer apparatus enters said reduced activity mode and for a delay time period after said printer apparatus enters said reduced activity mode, said belt support device returning said rotational speed of said belt to said first speed based on a new printing request being received during said delay time period, and said belt support device stopping rotation of said belt and reducing said belt tension to a second tension, less than said first tension, based on said delay time period expiring without receiving said new printing request.

2. The printer apparatus according to claim 1, said processor tracking a pattern of delay between successive print requests, and said processor adjusting said delay time period to reduce a frequency of changing said belt tension based on said pattern of delay between successive print requests.

3. The printer apparatus according to claim 1, said belt support device returning said rotational speed of said belt to said first speed and returning said belt tension to said first tension based on said new printing request being received after said delay time period has expired.

4. The printer apparatus according to claim 1, said second tension being less than 50% of said first tension.

5. The printer apparatus according to claim 1, said second speed being less than 10% of said first speed.

6. A printer apparatus comprising:

a processor;

a media path operatively connected to said processor, said media path transporting print media within said printer apparatus;

a dispensing apparatus operatively connected to said processor, said dispensing apparatus maintaining toner;

a charging device operatively connected to said processor;

a photoreceptor belt operatively connected to said processor, said photoreceptor belt being positioned adjacent said dispensing apparatus and said charging device, said charging device transferring a charge pattern to said photoreceptor belt, said dispensing apparatus placing said toner on said photoreceptor belt based on said charge pattern, said photoreceptor belt transferring said toner to said print media; and a belt support device operatively connected to said processor, said photoreceptor belt being mounted on said belt support device, said belt support device controlling a rotational speed of said photoreceptor belt and a belt tension of said photoreceptor belt, said belt support device rotating said photoreceptor belt at a first speed and maintaining said belt tension at a first tension when said photoreceptor belt is transferring said toner to said print media, said processor placing said printer apparatus in a reduced activity mode based on a lack of printing requests being received for an inactivity time period, said belt support device rotating said photoreceptor belt at a second speed, less than said first speed, when said printer apparatus enters said reduced activity mode and for a delay time period after said printer apparatus enters said reduced activity mode, said belt support device returning said rotational speed of said photoreceptor belt to said first speed based on a new printing request being received during said delay time period, and said belt support device stopping rotation of said photoreceptor belt and reducing said belt tension to a second tension, less than said first tension, based on said delay time period expiring without receiving said new printing request.

7. The printer apparatus according to claim 6, said processor tracking a pattern of delay between successive print requests, and said processor adjusting said delay time period to reduce a frequency of changing said belt tension based on said pattern of delay between successive print requests.

8. The printer apparatus according to claim 6, said belt support device returning said rotational speed of said photoreceptor belt to said first speed and returning said belt tension to said first tension based on said new printing request being received after said delay time period has expired.

9. The printer apparatus according to claim 6, said second tension less being than 50% of said first tension.

10. The printer apparatus according to claim 6, said second speed being less than 10% of said first speed.

11. A method comprising:

transporting print media within a printer apparatus using a media path within said printer apparatus;

placing marking material on a belt within said printer apparatus using a dispensing apparatus within said printer apparatus, said dispensing apparatus maintaining said marking material;

transferring said marking material from said belt to said print media;

supporting said belt using a belt support device within said printer apparatus;

controlling a rotational speed of said belt and a belt tension of said belt using said belt support device;

rotating said belt at a first speed and maintaining said belt tension at a first tension when said belt is transferring said marking material to said print media, using said belt support device;

placing said printer apparatus in a reduced activity mode based on a lack of printing requests being received for an inactivity time period, using a processor within said printer apparatus;

rotating said belt at a second speed, less than said first speed, when said printer apparatus enters said reduced activity mode and for a delay time period after said printer apparatus enters said reduced activity mode, using said belt support device;

returning said rotational speed of said belt to said first speed based on a new printing request being received during said delay time period, using said belt support device; and stopping rotation of said belt and reducing said belt tension to a second tension, less than said first tension, based on said delay time period expiring without receiving said new printing request, using said belt support device.

12. The method according to claim 11, further comprising: tracking a pattern of delay between successive print requests, using said processor; and adjusting said delay time period to reduce a frequency of changing said belt tension based on said pattern of delay between successive print requests, using said processor.

13. The method according to claim 11, further comprising returning said rotational speed of said belt to said first speed and returning said belt tension to said first tension based on said new printing request being received after said delay time period has expired, using said belt support device.

14. The method according to claim 11, said second tension being less than 50% of said first tension.

15. The method according to claim 11, said second speed being less than 10% of said first speed.

16. A non-transitory computer storage medium readable by a processor and storing instructions, said processor reading and executing said instructions to perform a method comprising:

transporting print media within a printer apparatus using a media path within said printer apparatus;

placing marking material on a belt within said printer apparatus using a dispensing apparatus within said printer apparatus, said dispensing apparatus maintaining said marking material;

transferring said marking material from said belt to said print media;

supporting said belt using a belt support device within said printer apparatus;

controlling a rotational speed of said belt and a belt tension of said belt using said belt support device;

rotating said belt at a first speed and maintaining said belt tension at a first tension when said belt is transferring said marking material to said print media, using said belt support device;

placing said printer apparatus in a reduced activity mode based on a lack of printing requests being received for an inactivity time period, using said processor within said printer apparatus;

rotating said belt at a second speed, less than said first speed, when said printer apparatus enters said reduced activity mode and for a delay time period after said printer apparatus enters said reduced activity mode, using said belt support device;

returning said rotational speed of said belt to said first speed based on a new printing request being received during said delay time period, using said belt support device; and stopping rotation of said belt and reducing said belt tension to a second tension, less than said first tension, based on said delay time period expiring without receiving said new printing request, using said belt support device.

17. The non-transitory computer storage medium according to claim 16, said method further comprising: tracking a pattern of delay between successive print requests, using said processor; and adjusting said delay time period to reduce a frequency of changing said belt tension based on said pattern of delay between successive print requests, using said processor.

18. The non-transitory computer storage medium according to claim 16, said method further comprising returning said rotational speed of said belt to said first speed and returning said belt tension to said first tension based on said new printing request being received after said delay time period has expired, using said belt support device.

19. The non-transitory computer storage medium according to claim 16, said second tension being less than 50% of said first tension.

20. The non-transitory computer storage medium according to claim 16, said second speed being less than 10% of said first speed.

* * * * *